US006018414A

United States Patent [19]

Chipper

[11] Patent Number: 6,018,414

[45] **Date of Patent: *Jan. 25, 2000**

[54] DUAL BAND INFRARED LENS ASSEMBLY USING DIFFRACTIVE OPTICS

[75] Inventor: Robert B. Chipper, Allen, Tex.

[73] Assignee: Raytheon Company, Lexington, Mass.

[ * ] Notice: This patent is subject to a terminal disclaimer.

[21] Appl. No.: 08/788,070

[22] Filed: Jan. 23, 1997

Related U.S. Application Data

[60] Provisional application No. 60/012,931, Mar. 4, 1996.

[51] Int. Cl.[7] ..... G08B 13/14

[52] U.S. Cl. ..... 359/356; 359/354; 359/357

[58] Field of Search ..... 359/350, 353, 359/354, 355, 356, 357; 250/330, 332

[56] References Cited

U.S. PATENT DOCUMENTS

| | | |
|---|---|---|
| 3,825,315 | 7/1974 | Altman et al. . |
| 3,846,820 | 11/1974 | Lampe et al. . |
| 4,007,978 | 2/1977 | Holton . |
| 4,018,608 | 4/1977 | Frazier . |
| 4,067,641 | 1/1978 | Holton . |
| 4,080,532 | 3/1978 | Hopper . |
| 4,084,130 | 4/1978 | Holton . |
| 4,085,550 | 4/1978 | Graham . |
| 4,142,207 | 2/1979 | McCormack et al. . |
| 4,143,269 | 3/1979 | McCormack et al. . |
| 4,162,402 | 7/1979 | Hopper . |
| 4,205,227 | 5/1980 | Reed . |
| 4,275,302 | 6/1981 | Imbert et al. . |
| 4,379,232 | 4/1983 | Hopper . |
| 4,411,732 | 10/1983 | Wotherspoon . |
| 4,431,917 | 2/1984 | Gibbons . |
| 4,447,291 | 5/1984 | Schulte . |
| 4,505,535 | 3/1985 | Neil ..... 359/357 |
| 4,594,507 | 6/1986 | Elliott et al. . |
| 4,614,957 | 9/1986 | Arch et al. . |
| 4,615,595 | 10/1986 | Hornbeck . |
| 4,621,888 | 11/1986 | Crossland et al. . |
| 4,639,756 | 1/1987 | Rosbeck et al. . |
| 4,684,812 | 8/1987 | Tew et al. . |
| 4,705,361 | 11/1987 | Frazier et al. . |
| 4,710,732 | 12/1987 | Hornbeck . |
| 4,751,387 | 6/1988 | Robillard . |
| 4,877,317 | 10/1989 | Gibbons et al. . |
| 4,948,976 | 8/1990 | Baliga et al. . |
| 4,956,619 | 9/1990 | Hornbeck . |
| 4,965,649 | 10/1990 | Zanio et al. . |
| 4,994,672 | 2/1991 | Cross et al. . |
| 5,010,251 | 4/1991 | Grinberg et al. . |
| 5,021,663 | 6/1991 | Hornbeck . |
| 5,044,706 | 9/1991 | Chen ..... 359/565 |
| 5,047,644 | 9/1991 | Meissner et al. . |
| 5,051,591 | 9/1991 | Trotta et al. . |
| 5,061,049 | 10/1991 | Hornbeck . |
| 5,083,857 | 1/1992 | Hornbeck . |
| 5,113,076 | 5/1992 | Schulte . |
| 5,132,848 | 7/1992 | Nishio et al. . |

(List continued on next page.)

FOREIGN PATENT DOCUMENTS

| | | |
|---|---|---|
| 939943 | 1/1974 | Canada . |
| 2 251 952 | 7/1992 | United Kingdom . |
| WO 91/16607 | 10/1991 | WIPO . |

OTHER PUBLICATIONS

U.S. Patent Application Serial No. 08/289,404, filed Aug. 12, 1994, "Durable Polomeric Optical Systems", Issuance Pending—Issue Fee Paid on Jan. 17, 1997.

*Primary Examiner*—Cassandra Spyrou
*Assistant Examiner*—Darren E. Schuberg
*Attorney, Agent, or Firm*—Baker & Botts, L.L.P.

[57] ABSTRACT

An infrared lens assembly (16, 60 and 80) operative in the near and far infrared wavebands to focus infrared radiation at an image plane (15) of an infrared detector (18). The infrared lens assembly (16, 60 and 80) includes a focusing component (33, 63 and 83), a collecting component (37, 65 and 85) and a diffracting component (41, 67 and 87). The focusing component (33, 63 and 83) and the collecting component (37, 65 and 85) may be formed from high dispersion, low index material. The diffracting component (41, 67 and 87) may be used to correct color aberrations associated with an infrared waveband.

26 Claims, 4 Drawing Sheets

U.S. PATENT DOCUMENTS

| | | | |
|---|---|---|---|
| 5,144,138 | 9/1992 | Kinch et al. . | |
| 5,188,970 | 2/1993 | York et al. . | |
| 5,196,703 | 3/1993 | Keenan . | |
| 5,229,880 | 7/1993 | Spencer et al. | 359/353 |
| 5,238,530 | 8/1993 | Douglas et al. . | |
| 5,257,133 | 10/1993 | Chen | 359/356 |
| 5,264,326 | 11/1993 | Meissner et al. . | |
| 5,313,331 | 5/1994 | Mihara . | |
| 5,346,532 | 9/1994 | Sinclair et al. . | |
| 5,424,869 | 6/1995 | Nanjo . | |
| 5,493,441 | 2/1996 | Chipper . | |
| 5,548,439 | 8/1996 | Smith | 359/353 |
| 5,559,332 | 9/1996 | Meissner et al. . | |
| 5,796,514 | 8/1998 | Chipper | 359/354 |

DUAL BAND INFRARED LENS ASSEMBLY USING DIFFRACTIVE OPTICS

This application claims priority under 35 U.S.C. § 119 (e) (1) of provisional application number 60/012.931, filed Mar. 4. 1996.

RELATED APPLICATION

This application is related to U.S. patent application Ser. No. 08/181,263, now U.S. Pat. No. 5,493,441, filed Jan. 13, 1994 entitled "INFRARED CONTINUOUS ZOOM TELESCOPE USING DIFFRACTIVE OPTICS"; U.S. patent application Ser. No. 09/100,156 filed Jun. 16, 1999 entitled "DUAL PURPOSE INFRARED LENS ASSEMBLY USING DIFFRACTIVE OPTICS"; U.S. patent application Ser. No. 08/786,944 filed Jan. 23, 1997 entitled "WIDE FIELD OF VIEW INFRARED ZOOM LENS ASSEMBLY HAVING A CONSTANT F/NUMBER"; and U.S. patent application Ser. No. 08/786,951 filed Jan. 23, 1997, now U.S. Pat. No. 5,796,514, entitled "INFRARED ZOOM LENS HAVING A VARIABLE F/NUMBER".

TECHNICAL FIELD OF THE INVENTION

This invention relates generally to optical systems, and more particularly to a dual band infrared lens assembly using diffractive optics.

BACKGROUND OF THE INVENTION

Infrared or thermal imaging systems typically use a plurality of thermal sensors to detect infrared radiation and produce an image capable of being visualized by the human eye. Thermal imaging systems typically detect thermal radiance differences between various objects in a scene and display these differences in thermal radiance as a visual image of the scene. Thermal imaging systems are often used to detect fires, overheating machinery, planes, vehicles and people, and to control temperature sensitive industrial processes.

The basic components of a thermal imaging system generally include optics for collecting and focusing infrared radiation from a scene, an infrared detector having a plurality of thermal sensors for converting infrared radiation to an electrical signal, and electronics for amplifying and processing the electrical signal into a visual display or for storage in an appropriate medium. A chopper is often included in a thermal imaging system to modulate the infrared radiation and to produce a constant background radiance which provides a reference signal. The electronic processing portion of the thermal imagining system will subtract the reference signal from the total radiance signal to produce a signal with minimum background bias.

Thermal imaging systems may use a variety of infrared detectors. An infrared detector is a device that responds to electromagnetic radiation in the infrared spectrum. Infrared detectors are sometimes classified into two main categories as cooled and uncooled. A cooled infrared detector is an infrared detector that must be operated at cryogenic temperatures, such at the temperature of liquid nitrogen, to obtain the desired sensitivity to variations in infrared radiation. Cooled detectors typically employ thermal sensors having small bandgap semiconductors that generate a change in voltage due to photoelectron interaction. This latter effect is sometimes called the internal photoelectric effect.

Uncooled infrared detectors cannot make use of small bandgap semiconductors because dark current swamps any signal at room temperature. Consequently, uncooled detectors rely on other physical phenomenon and are less sensitive than cooled detectors. However, because uncooled detectors do not require the energy consumption of cooled detectors, they are the preferred choice for portable, low power, applications where the greater sensitivity of cooled detectors is not needed. In a typical uncooled thermal detector, infrared photons are absorbed and the resulting temperature difference of the absorbing element is detected. Thermal detectors include pyroelectric detector, a thermocouple, or a bolometer.

An infrared window is a frequency region in the infrared spectrum where there is good transmission of electromagnetic radiation through the atmosphere. Typically, infrared detectors sense infrared radiation in the spectral bands from 3 to 5 microns (having an energy of 0.4 to 0.25 eV) and from 8 to 14 microns (having an energy of 0.16 to 0.09 eV). The 3–5 micron spectral band is generally termed the "near infrared band" while the 8 to 14 micron spectral band is termed the "far infrared band." Infrared radiation between the near and far infrared bands cannot normally be detected due to atmospheric absorption of the same.

Infrared radiation is generally focused onto a thermal detector by one or more infrared lens. Infrared lenses typically are designed either as a near band infrared lens capable of focusing infrared radiation in the 3–5 micron spectral band or as a far infrared band lens capable of focusing infrared radiation in the 8–14 micron spectral band. Such lens customization, however, is expensive, requiring separate lens systems to be designed and fabricated for use in the near and far infrared bands.

SUMMARY OF THE INVENTION

In accordance with the present invention, a dual band infrared lens assembly using diffractive optics is provided that substantially eliminates or reduces the disadvantages and problems associated with prior infrared detection systems.

In accordance with the present invention, an infrared lens assembly operative in the near and far infrared wavebands is provided with a plurality of components positioned along an optical axis to focus infrared radiation of an object. A focusing component includes at least one focusing lens. The focusing lens may be formed of a material that has a minimal change in Abbe V-number between the far and near infrared wavebands. A collecting component includes at least one collecting lens that may also be formed of the material. A diffracting component includes at least one diffractive surface that may be employed to correct color aberrations associated with an infrared waveband. The focusing and collecting components cooperate with the diffractive component to focus infrared radiation of the object onto an image plane of an associated infrared detector.

More specifically, a diffractive lens incorporating the diffractive surface may be removably mounted in the infrared lens assembly. To reduce cost, the diffractive lens may be formed from an inexpensive polymer. The focusing and collecting lenses may be made from chalcogenide glass or other material having infrared transmitting properties that change minimally between the near and far infrared wavebands, more specifically a small change in Abbe V-number. The difference between the far infrared V-number and the near infrared V-number of the glass should be less than 70. The small difference in V-number between wavebands allows the lens to be optimized to reduce the non-color dependant image degrading aberrations for both the near and far infrared wavebands. The color dependant aberrations would then be reduced through the use of removable polymer diffractive lenses.

In accordance with another aspect of the present invention, a zoom lens system is provided having various focusing lenses. In this embodiment, the focusing component includes an objective focusing lens and a pair of zoom focusing lenses positioned between the objective lens and the collecting component. The collecting component includes a first collecting lens positioned proximate to an image plane and a second collecting lens positioned between the first collecting lens and the zoom lenses. The diffractive lens may be positioned proximate to the objective focusing lens. A second diffractive lens of the diffractive component may be positioned between the zoom focusing lenses and collective lenses. In this embodiment, the diffractive lens may be used to correct axial color focusing aberrations and the second diffractive lens may be used to correct lateral color focusing aberrations.

An alternative diffractive lens and a second alternative diffractive lens operable to correct color aberrations associated with a different infrared waveband may also be provided. For this embodiment, the diffractive lens and the alternative diffractive lens may be retained in a filter wheel positioned proximate to the objective focusing lens. The second diffractive lens and the second alternative diffractive lens may be retained in a second filter wheel positioned between the zoom focusing lenses and the collecting lenses. Each of the filter wheels may be operated to selectably position the primary or alternate diffractive lens along the optical axis for optical communication with the focusing and collecting components.

Important technical advantages of the present invention include providing an infrared lens assembly operable in the near and far infrared wavebands. Another important technical advantage of the present invention includes providing a relatively low cost infrared lens assembly. In particular, separate infrared lens assemblies need not be designed and fabricated for use in the near and far infrared wavebands. Thus, the present invention provides a low cost infrared lens assembly by eliminating the cost of designing and fabricating different lens assemblies to operate in the near and far infrared wavebands.

Still another important technical advantage of the present invention includes providing a dual band infrared imaging system. In particular, the present invention provides a dual band lens assembly that can be combined with a dual band detector to form a dual band infrared imaging system. The dual band infrared imaging system can be switched between the near and far infrared bands to better perceive a heat source under prevailing conditions.

Other technical advantages will be readily apparent to one skilled in the art from the following figures, descriptions, and claims.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

Figure 1:
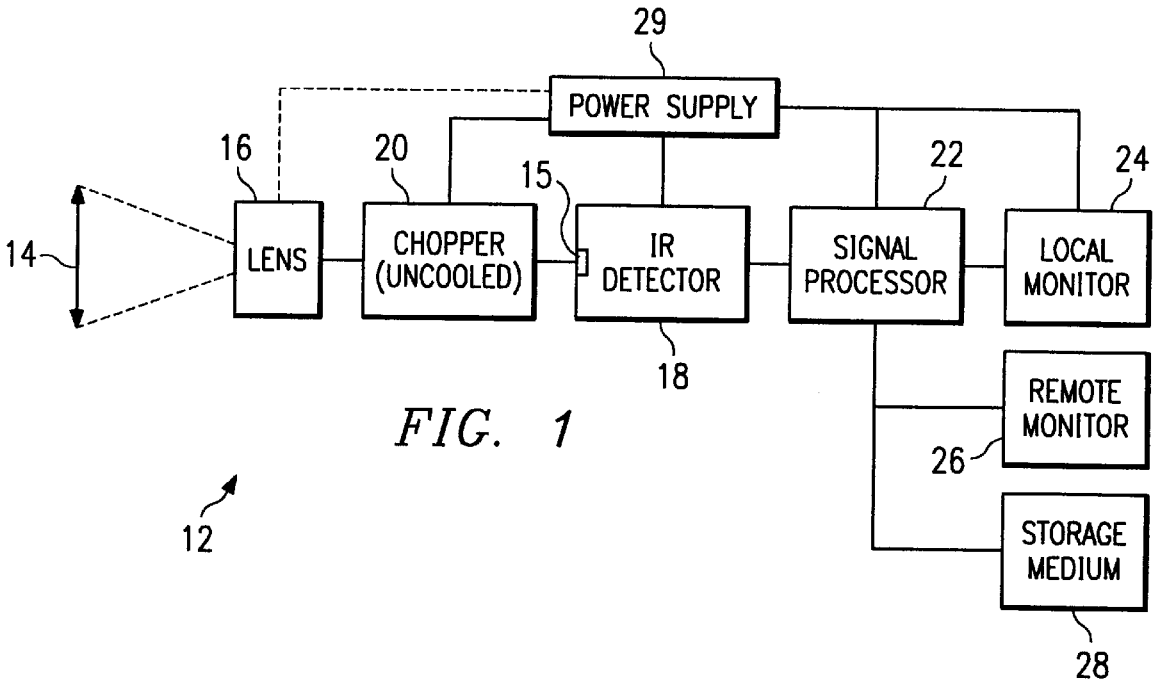
FIG. 1 is a block diagram of an infrared imaging system with a dual band lens assembly using diffractive optics in accordance with one aspect of the present invention.

The preferred embodiments of the present invention and its advantages are best understood by referring now to FIGS. 1 through 5 of the drawings, in which like numerals refer to like parts throughout the several views. FIG. 1 shows a schematic block diagram of an infrared imaging system 12 for detecting, processing, and displaying the heat image of an object 14. The infrared imaging system 12 may be used to detect fires, overheating machinery, planes, vehicles and people, and to control temperature sensitive industrial processes.

As shown by FIG. 1, the infrared imaging system 12 comprises a lens assembly 16 in optical communication with an infrared detector 18. The infrared detector 18 senses infrared radiation, typically, in the spectral bands from 3 to 5 microns (having an energy of 0.4 to 0.25 eV) and from 8 to 14 microns (having an energy of 0.16 to 0.09 eV). The 3–5 micron spectral band is generally termed the "near infrared band" while the 8 to 14 micron spectral band is termed the "far infrared band." Infrared radiation between the near and far infrared bands cannot normally be detected due to atmospheric absorption.

The lens assembly 16 focuses or directs infrared radiation emitted by the object 14 onto an image plane 15 of the infrared detector 18. In cases where an uncooled detector 18 is used, a chopper 20 is often disposed between the lens assembly 16 and the infrared detector 18. The chopper 20 may be controlled by a signal processor 22 to periodically interrupt transmission of the infrared image to the image plane 15 of the infrared detector 18. The chopper 20 may be a rotating disk with openings that periodically block and let pass infrared radiation.

The infrared detector 18 translates incoming infrared radiation into one or more images and corresponding electrical signals for processing. Electrical signals are fed to the signal processor 22, which assembles electrical signals into video signals for display. As previously described, the signal processor 22 may also synchronize operation of the chopper 20. This synchronization enables the signal processor 22 to subtractively process incoming infrared radiation to eliminate both fixed infrared background radiation and time constant noise. The output of the signal processor 22 is often a video signal that may be viewed, further process, stored, or the like.

The video signal may be viewed on a local monitor 24 or fed to a remote monitor 26 for display. The local monitor 24 may be an eye piece containing an electronic viewfinder, a cathode ray tube, or the like. Similarly, the remote monitor 26 may comprise an electronic display, a cathode ray tube, such as a television, or other type of device capable of displaying the video signal. The video signal may also be saved to a storage medium 28 for later recall. The storage medium 28 may be a compact disk, a hard disk drive, random access memory, or any other type of medium capable of storing electronic video signals for later recall. Monitors and storage mediums are well known in the art and therefore will not be further described herein.

Electrical power to operate the infrared imager system 12 may be provided by a power supply 29. The power supply 29 provides electrical power directly to the chopper 20, the infrared detector 18, the signal processor 22, and to the local monitor 24. Electrical power may also be provided to the lens 16, when, for example, a motor is employed to focus the lens 16.

Figure 2A:
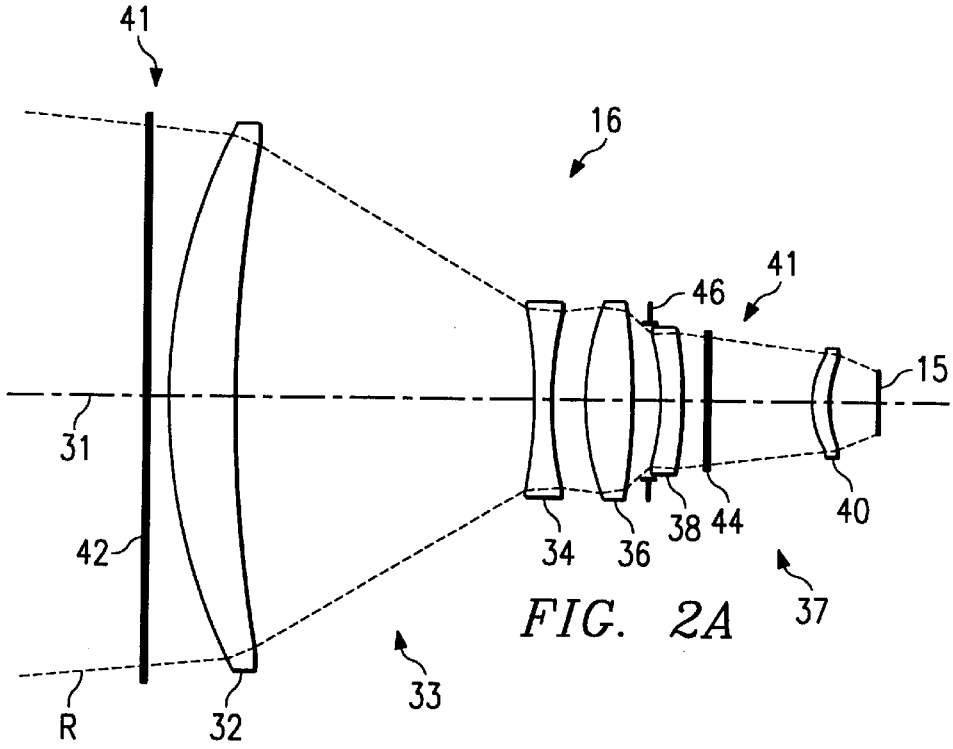
FIGS. 2A–B are schematic drawings of the dual band lens assembly of FIG. 1.
Figure 2B:
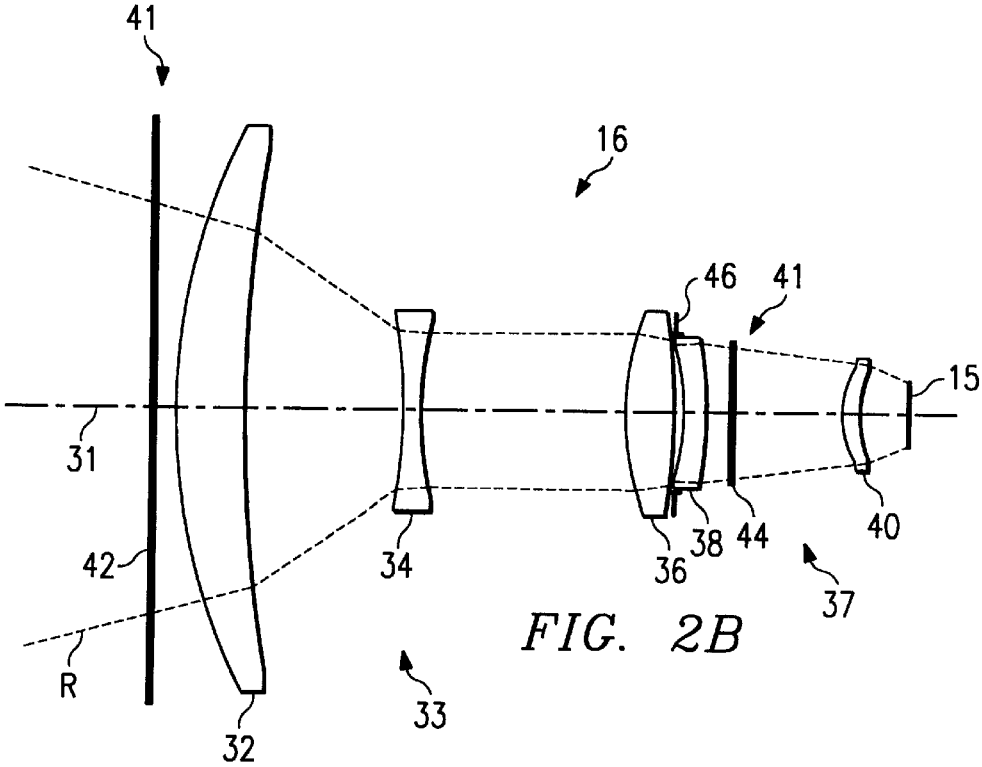
Figure 3A:
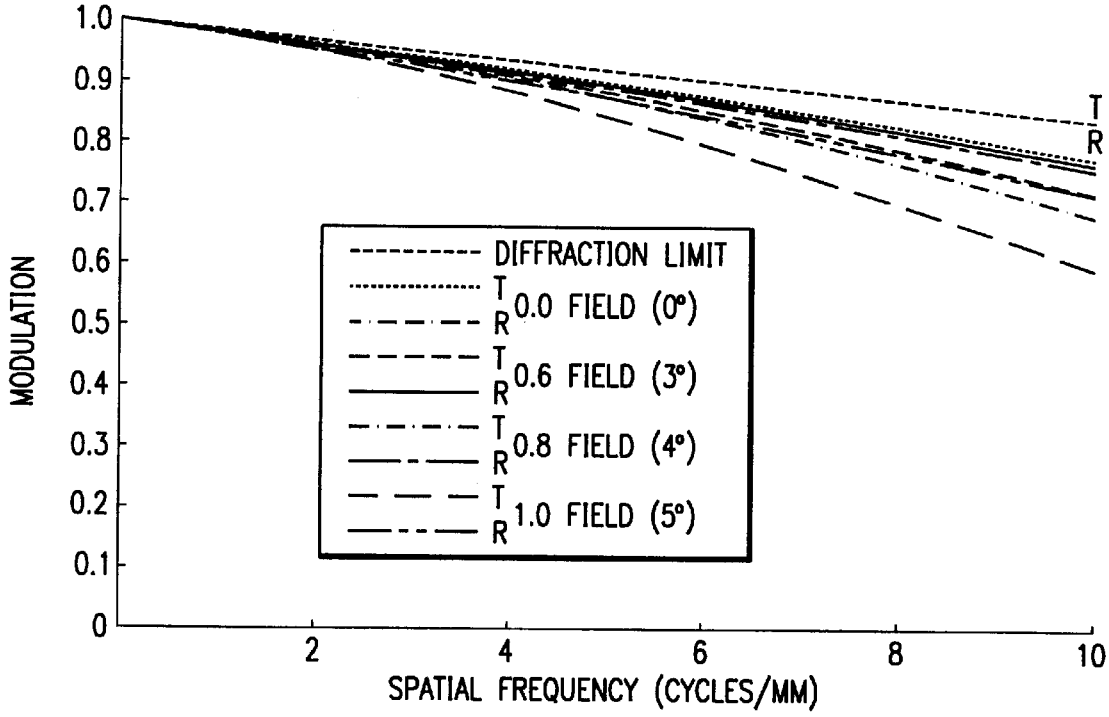
FIGS. 3A–B are frequency drawings of the dual band lens assembly of FIGS. 2A–B, showing modulation transfer function performance of the lens, which is a measure of contrast, versus spatial frequency.
Figure 3B:
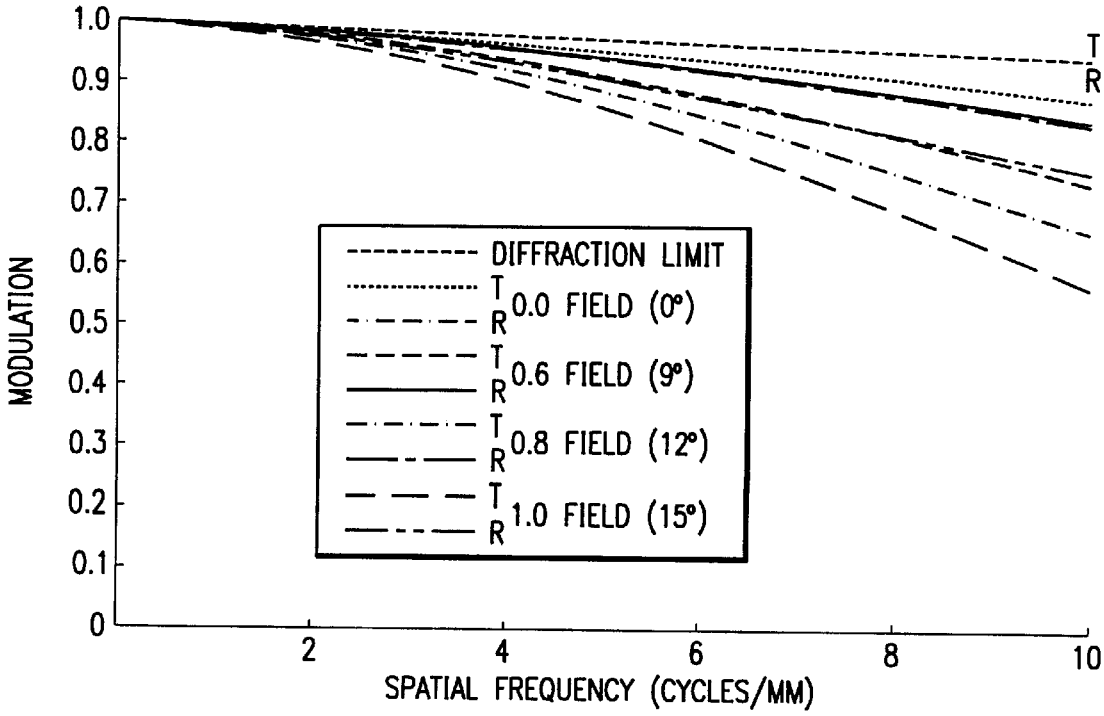

FIGS. 2A–B are schematic drawings of lens assembly 16 incorporating an embodiment of the present invention. In this embodiment, lens assembly 16 may be generally described as a zoom lens having a retracted position shown in FIG. 2A and an extended position shown in FIG. 2B. Preferably, lens assembly 16 is approximately 215 millimeters in overall length and operable over a horizontal field of view of eight to twenty-four degrees (8°–24°) and yielding a 3:1 zoom ratio. Graphs of the performance of lens assembly 16 verses spacial frequency are shown for the retracted zoom position in FIG. 3A and for the extended zoom position in FIG. 3B.

As shown by FIGS. 2A–B, the various components of lens assembly 16 are positioned along an optical axis 31. Zoom lens assembly 16 comprises a focusing component 33 including a fixed objective lens 32 and a pair of moveable zoom lenses 34 and 36. A collecting component 37 includes a pair of fixed collecting lenses 38 and 40. A diffracting component 41 includes a pair of diffractive lenses 42 and 44. An aperture stop 46 may be mounted on a first side of collecting lens 38. The aperture stop 46 determines the diameter of the cone of infrared energy that the lens assembly 16 will accept by limiting the passage of infrared energy through the lens. The cone of infrared energy that the zoom lens assembly 16 will accept is shown by ray trace R.

In accordance with conventional practice, the radius of curvature of the lens elements will be defined as positive if the center of curvature lies to the right of the lens element and will be defined as negative if the center of curvature lies to the left of the lens element along optical axis 31. A lens element will be defined as converging if the lens focussing power causes parallel light rays to converge, and will be defined as diverging if the lens focussing power causes parallel light rays to appear to originate from a virtual focus. Further, a side of a lens will be defined as a first side if facing the object 14 and defined as a second side if facing the image plane 15.

For the embodiment of FIGS. 2A–B, objective lens 32 is a positive converging lens. Focusing zoom lens 34 is a negative diverging lens while focusing zoom lens 36 is a positive converging lens. Focusing zoom lenses 34 and 36 move relative to each other in a nonlinear fashion. As best shown by comparison of FIGS. 2A–B, as lens assembly 16 is zoomed, focusing zoom lens 34 moves toward the objective lens 32 while focusing zoom lens 36 moves in the opposite direction toward the collecting lens 38. Collecting lens 38 is a negative diverging lens while collecting lens 40 is a positive converging lens. Objective lens 32, focusing zoom lenses 34 and 36, and collecting lenses 38 and 40 cooperate with diffractive lenses 42 and 44, which are discussed below in detail, to focus infrared radiation emitted by object 14 onto the image plane 15 of the infrared detector 18. Preferably, infrared detector 18 is an uncooled detector for use in connection with lens assembly 16.

A significant feature of the present invention is the construction of the objective lens 32, the zoom lenses 34 and 36, and the collecting lenses 38 and 40 of a single material having infrared transmitting properties that change minimally between the near and far infrared wavebands. This material may be a glass or a similar type of infrared transmitting material having a small difference in Abbe V-number between the far and near infrared wavebands.

The refractive index of a material is the ratio of the speed of light in a vacuum (essentially the same as in air) to the speed of light in the material. The dispersion rate of a material is the rate of change of the refractive index of the material with respect to wavelength. The dispersion rate may be expressed as an Abbe V-number, which is a measure of the reciprocal relative dispersion. Thus, a high dispersion rate corresponds to a low Abbe V-number and visa-versa.

Materials which have a minimal change in Abbe V-number between the far and near infrared wavebands include Gallium Arsenide (GaAs) and chalcogenide glass, such as TI 1173 manufactured by Texas Instruments Incorporated. Germanium, which is often the preferred material for far infrared lenses, has a low dispersion rate in the far infrared band, a high refractive index and more importantly has a delta V-number between the far and near infrared wavebands of over 800. Thus, it is not a desired material. Germanium is preferred in other infrared lens applications because lenses having a high refractive index need less curvature than lenses with a lower refractive index. Thus, use of a high index material makes it is easer to correct for image aberrations such as spherical, coma, and astigmatism.

The properties of TI 1173, Gallium Arsenide, and Germanium in the near and far infrared bands are listed below in Table 1. In Table 1, the Abbe V-number is a measure of the reciprocal relative dispersion of the material.

TABLE 1

| | INDEX | | ABBE V-NUMBER | |
|---|---|---|---|---|
| Material | 10 Micron | 4 Micron | Far Infrared Band | Near Infrared Band |
| TI 1173 | 2.604 | 2.622 | 108 | 169 |
| GaAs | 3.278 | 3.307 | 108 | 146 |
| Ge | 4.003 | 4.025 | 991 | 102 |

From Table 1, for a high dispersion, low index material such as TI 1173, the properties change very little between the near and far infrared wavebands. Accordingly, lens assembly 16 is equally applicable to the near and far infrared bands.

As previously discussed, low index materials, such as TI 1173, have a reduced capacity to bend light. To compensate, the lens elements of zoom lens assembly 16 may have larger curvatures than would otherwise be used. Consequently, it may be more difficult to reduce image degrading aberrations, such as spherical, coma, and astigmatism. To reduce such image degrading aberrations, objective lens 32, zoom lenses 34 and 36, and collecting lenses 38 and 40 may include aspheric surfaces. The general equation for an aspheric surface is:

$$Z = \frac{(CC)Y^2}{1 + [1 - (1 + K)(CC)^2 Y^2]^{1/2}} + AY^4 + BY^6 + CY^8 + DY^{10}$$

where: Z is Sag value along the z-axis;

Y is the semi-diameter height;

CC is the base curvature (1/radius) of the surface;

K is the conic coefficient; and

A, B, C and D are the 4th, 6th, 8th and 10th order aspheric coefficients, respectively.

The coefficients of the aspheric surfaces of objective lens 32, zoom lenses 34 and 36, and collecting lenses 38 and 40 are listed below in Table 2.

TABLE 2

Aspheric Surface Coefficients

| Parameter | | O[001b]bjective Lens 32 | Zoom Lens 34 | Zoom Lens 36 | Collecting Lens 38 | Collecting Lens 40 |
|---|---|---|---|---|---|---|
| Curavture (CC) | | | | | | |
| Surface 1 | | .137458 | −.170144 | .314989 | −.354656 | 1.117680 |
| Surface 2 | | .055131 | .188207 | −.174431 | −.169180 | 1.036259 |
| Aspheric Coefficients | | | | | | |
| K | S1 | 0 | 0 | 0 | 0 | 0 |
| A4 | S1 | −.322609E−3 | 0 | −.704277E−2 | .292998E−1 | −.950722E−1 |
| A6 | S1 | .732087E−4 | 0 | −.651601E−3 | −.874693E−2 | −.857472E−1 |
| A8 | S1 | .424448E−5 | 0 | −.941183E−4 | .531724E−2 | −.216130E+1 |
| A10 | S1 | −.213282E−6 | 0 | −.106564E−3 | −.179990E−2 | −.218613E+1 |
| K | S2 | 0 | 0 | 0 | 0 | 0 |
| A4 | S2 | −.447040E−3 | −.571918E−2. | .128625E−1 | 0 | −.138371E+0 |
| A6 | S2 | .131210E−3 | .165578E−3 | −.408107E−2 | 0 | .320834E+0 |
| A8 | S2 | .123002E−5 | −.768064E−3 | .163427E−2 | 0 | −.119850E+2 |
| A10 | S2 | −.311243E−6 | .359986E−3 | −.514114E−3 | 0 | .174114E+2 |

The aspheric surfaces of the lens elements may be formed by press molding or by grinding operations. Further information concerning molding of the lens elements is disclosed by commonly assigned U.S. Pat. No. 5,346,523, entitled "METHOD OF MOLDING CHALCOGENIDE GLASS LENSES." Shaping of lenses is well known in the art and therefore will not be further described.

A chalcogenide glass, such as TI 1173, generally has a low DN/DT (delta refractive index/delta temperature) value, which is the rate of change of a material's refractive index with changes in temperature. If a chalcogenide glass or other material having a low DN/DT value is used to construct the lens elements, lens assembly 16 may be passively athermalized. That is, constructed to hold focus with changes in temperature without aid of a motor or similar device.

Lens assembly 16 may be passively athermalized by mounting collecting lens 40 against a plastic spacer (not shown). The spacer expands and contracts with temperature changes in relation to the change of the refractive index of the lens elements. Thus, as the temperature changes, and the refractive index of the lens elements change, the spacer expands or contracts to position the collecting lens 40 to where it accounts for the change in refractive index of the lenses.

Diffractive lenses 42 and 44 each comprise an infrared transmitting material having a diffractive surface. The diffractive surface may be a kinoform produced by diamond point turning, patterned and etched, or the like. Kinoforms are diffractive elements whose phase modulation is introduced by a surface relief pattern. The diffractive optical surface results in a step function whose surface is cut back by precisely one wavelength of the light frequency of interest, preferably 4 microns for the near infrared band and 10 microns for the far infrared band, every time their thickness increases by that amount. The general equation for a diffractive surface is:

$$Z = \frac{(CC)*Y^2}{1+\mathrm{SQRT}[1-(1+K)(CC)^2Y^2]} + AY^4 + BY^6 + CY^8 + DY^{10} + [HOR]* \left(\frac{C1Y^2 + C2Y^4 + C3Y^6}{(N1-N2)} - \frac{\lambda}{N1-N2)} * \mathrm{INT}\frac{[C1Y^2 + C2Y^4 + C3Y^6]}{\lambda}\right)$$

where: Z is Sag value along the Z-axis or optical axis;

Y is the semi-diameter height;

CC is the base curvature (1/radius) of the surface;

K is the conic coefficient of surface;

A,B,C, and D are the 4th, 6th, 8th and 10th order aspheric coefficients, respectively;

HOR is the diffraction order, generally 1 or −1;

λ is the design wavelength for surface;

N1 is the Refractive index of material preceding diffractive surface;

N2 is the Refractive index of material following diffractive surface; and

C1, C2, and C3 are coefficients for describing aspheric phase departure.

The diffractive kinoform surface coefficients of diffractive lenses 42 and 44 are listed below in Table 3.

TABLE 3

DIFFRACTIVE KINOFORM SURFACE COEFFICIENTS

| Parameter | Diffractive Lens 42 | Diffractive Lens 44 |
|---|---|---|
| HOR | −1 | −1 |
| λ (inches) | 4 e−4 | 4 e−4 |
| N1 | 1.5 | 1.5 |
| N-2 | 1.0 | 1.0 |
| CC (inches) | 0 | 0 |
| K | 0 | 0 |
| A | 0 | 0 |
| B | 0 | 0 |
| C | 0 | 0 |
| D | 0 | 0 |

TABLE 3-continued

DIFFRACTIVE KINOFORM SURFACE COEFFICIENTS

| Parameter | Diffractive Lens 42 | Diffractive Lens 44 |
|---|---|---|
| C1 | 1.1294E−03 | 7.8334E−03 |
| C2 | 0 | 0 |
| C3 | 0 | 0 |

Further information concerning kinoform diffractive surfaces is disclosed by commonly assigned U.S. patent application Ser. No. 08/181,263, filed Jan. 13, 1994, and entitled "INFRARED CONTINUOUS ZOOM TELESCOPE USING DIFFRACTIVE OPTICS," which is hereby incorporated by reference.

As shown by FIGS. 2A–B, diffractive lens 42 may be positioned in front of the object lens 32 to control axial color. Specifically, diffractive lens 42 may correct axial color focusing aberrations. The diffractive surface may be formed on a second side of the diffractive lens 42 facing the object lens 32. In such a case, the first side of the diffractive lens 42 may be used as a protective window to prevent dust and other elements from entering lens assembly 16.

Diffractive lens 44 may be positioned between collecting lenses 38 and 40 to control lateral color. Specifically, diffractive lens 44 may correct lateral color focusing aberrations. Both diffractive lenses 42 and 44 are fixed in position. To keep the cost of the lens assembly 16 down, diffractive lenses 42 and 44 are preferably constructed of an inexpensive polymer material such as that described in commonly assigned U.S. patent application Ser. No. 08/289,404 filed Aug. 12, 1994, which is hereby incorporated by reference.

Although lens assembly 16 includes two diffractive surfaces for color correction, it will be understood by those skilled in the art that a single diffractive surface may be used in accordance with the present invention. A single diffractive surface, however, may not correct color aberrations as well as the pair of diffractive surfaces employed by lens assembly 16. Additionally, although the diffractive surfaces are formed as separate lenses in zoom lens assembly 16, it will be understood by those skilled in the art that the diffractive surface can be formed on a second side of a lens element. For example, the diffractive surface of diffractive lens 42 could be formed instead on a second side of objective lens 32, thus eliminating the need for the separate diffractive lens 42.

Diffractive lenses 42 and 44 are designed to correct color in the near infrared waveband or in the far infrared waveband. As previously described, the light frequency of interest by which the diffractive surface is cut by one wavelength is 4 microns for the near infrared band. The light frequency of interest for the far infrared waveband is 10 microns. Accordingly, diffractive lenses 42 and 44 may be removably mounted in the lens assembly 16 so they may be removed and replaced with diffractive lenses for a different infrared waveband. Thus, lens assembly 16 can be switched between the near and far infrared wavebands by simply exchanging diffractive lenses 42 and 44, which are inexpensive and easy to exchange. The critical and expensive objective lens 32, zoom lenses 34 and 36, and collecting lenses 38 and 40 need not be altered between infrared wavebands. Therefore, in accordance with the present invention, a single type of infrared lens can be designed and fabricated for use in both the near and far infrared bands.

If desired, alternate diffractive lenses for the near and far infrared bands can be selectably mounted on a filter wheel for diffractive lenses 42 and 44. In this configuration, the dual band lens can be combined with a dual band detector to form a dual band infrared imager system that can be switched between the near and far infrared bands to better perceive a heat source under prevailing conditions.

Figure 4:
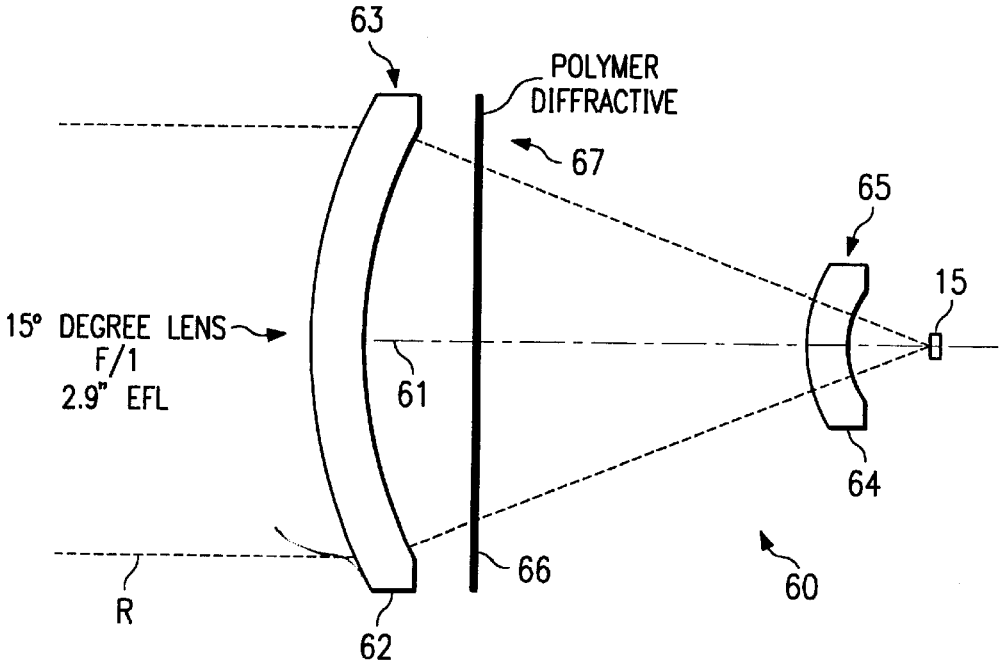
FIG. 4 is a schematic drawing showing a dual band lens assembly incorporating an alternative embodiment of the present invention.

FIG. 4 is a schematic drawing of a dual band lens assembly 60 incorporating another embodiment of the present invention. In this embodiment, lens assembly 60 is a single field of view lens. Preferably, lens assembly 60 has an F-number of 1, an effective focal length of 2.9, and is operable at 15 degrees horizontal field of view.

As shown by FIG. 4, the components of lens assembly 60 are positioned along an optic axis 61. Lens assembly 60 comprises a focusing component 63 including a fixed objective lens 62, a collecting component 65 including a fixed collecting lens 64, and a diffractive component 67 including diffractive lens 66.

For the embodiment of FIG. 4, objective lens 62 and collecting lens 64 are positive converging lenses. Together, they cooperate with diffractive lens 66 to focus infrared radiation emitted by object 14 onto the image plane 15 of the infrared detector 18. Preferably, infrared detector 18 is an uncooled detector for use in connection with lens assembly 60.

As previously described, a significant feature of the present invention is a construction of the lens elements of a single material having infrared transmitting properties that change minimally between the near and far infrared wavebands.

Materials which have a minimal change in Abbe V-number between the far and near infrared wavebands include Gallium Arsenide (GaAs) and chalcogenide glass, such as TI 1173 manufactured by Texas Instruments Incorporated. From Table 1, which shows the properties of TI 1173, Gallium Arsenide, and Germanium in the near and far infrared bands, the properties of a high dispersion, low index material such as TI 1173 change very little between the near and far infrared wavebands. Accordingly, lens assembly 60 is equally applicable to the near and far infrared wavebands.

To reduce image degrading aberrations associated with the use of low index lens material, objective lens 62 and collecting lens 64 may include aspheric surfaces. The aspheric surfaces of the lens elements may be formed as previously described in connection with FIGS. 2A–B. Additionally, as also previously described, lens assembly 60 may be passively athermalized.

Diffractive lens 66 comprises an infrared transmitting material having a diffractive surface. As previously described, the diffractive surface may be a kinoform produced by diamond point turning, patterned and etched, or the like.

As shown by FIG. 4, diffractive lens 66 may be positioned between objective lens 62 and collecting lens 64 to control color. Specifically, diffractive lens 66 corrects axial and lateral color focusing aberrations, if present.

Diffractive lens 66 corrects color in the near infrared waveband or in the far infrared waveband. As previously described, the light frequency of interest by which the diffractive surface is cut by one wavelength is 4 microns for the near infrared waveband. The light frequency of interest for the far infrared waveband is 10 microns. Accordingly, diffractive lens 66 may be removably mounted in lens assembly 60 so that it may be removed and replaced with a diffractive lens for a different infrared waveband. Thus, lens assembly 60 can be switched between the near and far infrared bands by simply exchanging diffractive lens 66, which is inexpensive and easy to exchange. The critical and expensive objective lens 62 and collecting lens 64 need not be altered between infrared wavebands. Therefore, in accordance with the present invention, a single type of infrared lens can be designed and fabricated for use in both the near and far infrared wavebands.

If desired, alternative diffractive lenses for the near and far infrared wavebands can be mounted onto a filter wheel from which they can be alternatively selected for use. In this configuration, as previously described, the dual band lens can be combined with a dual band infrared detector to form a dual band infrared imager system that can be switched between the near and far infrared bands to better perceive a heat source under prevailing conditions.

Figure 5:
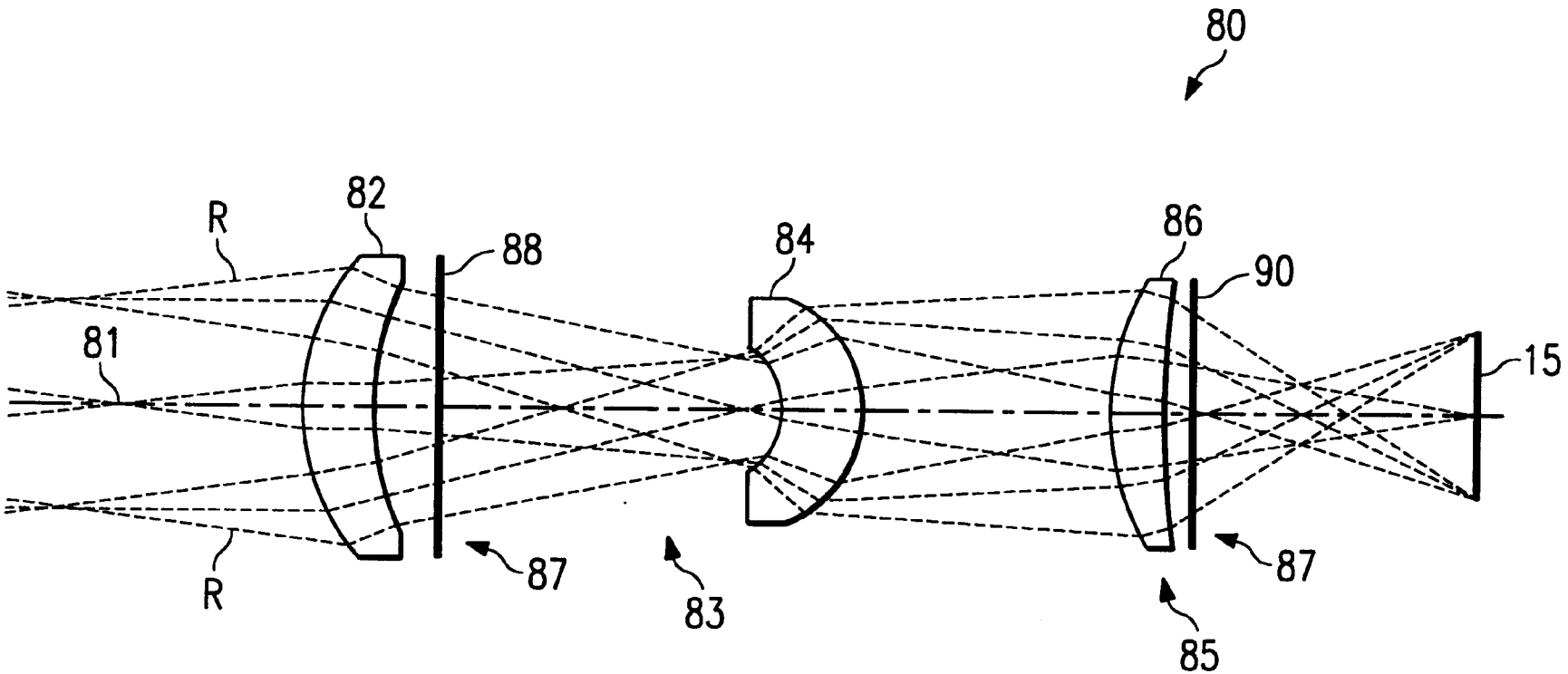
FIG. 5 is a schematic drawing showing a dual band lens assembly incorporating an alternative embodiment of the present invention.

FIG. 5 is a schematic drawing of a dual band lens assembly 80 incorporating another embodiment of the present invention. In this embodiment, lens assembly 80 is a single field of view lens.

As shown by FIG. 5, the components of lens assembly 80 may be positioned along an optical axis 81. Lens assembly 80 comprises a focusing component 83 including a fixed objective lens 82 and a fixed redirecting lens 84. A collecting component 85 includes a fixed collecting lens 86. A diffractive component 87 includes a pair of diffractive lenses 88 and 90.

For the embodiment of FIG. 5, objective lens 82 is a positive converging lens. Redirecting lens 84 is a positive converging lens. Collecting lens 86 is a positive converging lens. Together, these lenses cooperate with diffractive lenses 88 and 90 to focus infrared radiation emitted by the object 14 onto the image plane 15 of the infrared detector 18. Infrared detector 18 may be a cooled top hat cold shielded detector for use in connection with lens assembly 80. In such a case, the chopper 20 need not be used between the lens assembly 80 and the detector 18.

As previously described, a significant feature of the present invention is a construction of the lens elements of a single material having infrared transmitting properties that change minimally between the near and far infrared wavebands.

Materials which have a minimal change in Abbe V-number between the far and near infrared wavebands include Gallium Arsenide (GaAs) and chalcogenide glass, such as TI-1173 manufactured by Texas Instruments Incorporated. From Table 1, which shows the properties of TI-1173, Gallium Arsenide, and Germanium in the near and far infrared bands, the properties of a high dispersion, low index material such as TI-1173 change very little between the near and far infrared wavebands. Accordingly, lens assembly 80 is equally applicable to the near and far wavebands.

To reduce image degrading aberrations associated with the use of low index lens material, objective lens 82, redirecting lens 84, and collecting lens 86 may include aspheric surfaces. The aspheric surfaces of the lens elements may be formed as previously described in connection with FIGS. 2A–B. Additionally, as also previously described, lens assembly 80 may be passively athermalized.

Diffractive lenses 88 and 90 comprise an infrared transmitting material having a diffractive surface. As previously described, the diffractive surface may be a kinoform produced by diamond point turning, patterned and etched, or the like.

As shown by FIG. 5, diffractive lens 88 may be positioned between objective lens 82 and redirecting lens 84 to control axial color. Specifically, diffractive lens 88 corrects axial color focusing aberrations. Diffractive lens 90 is positioned between collecting lens 86 and the image plane 15 to control lateral color. Specifically, diffractive lens 90 corrects lateral color focusing aberrations. Both diffractive lenses 88 and 90 are fixed in position.

Diffractive lenses 88 and 90 correct color in the near infrared waveband or in the far infrared waveband. As previously described, the light frequency of interest for the near infrared waveband is 4 microns. The light frequency of interest for the far infrared waveband is 10 microns. Accordingly, diffractive lenses 88 and 90 may be removably mounted in the lens assembly 80 so that they may be removed and replaced with diffractive lenses for a different infrared waveband. Thus, lens assembly 80 can be switched between the near and far infrared bands by simply exchanging diffractive lenses 88 and 90, which are inexpensive and easy to exchange. The critical and expensive objective lens 82, redirecting lens 84, and collecting lens 86 need not be altered between infrared wavebands. Therefore, in accordance with the present invention a single type of infrared lens can be designed and fabricated for use in both the near and far infrared wavebands.

If desired, alternative diffractive lenses for the near and far infrared wavebands can be mounted onto a filter wheel from which they may be alternatively selected for use. In this configuration, a previously described, the dual band lens can be combined with a dual band cooled detector to form a dual band infrared imager system that can be switched between the near and far infrared bands to better perceive the heat source under prevailing conditions.

Though the present invention and its advantages have been described in detail, it should be understood that various changes, substitutions and alterations can be made herein without departing from the spirit and scope of the invention as defined by the appended claims.

What is claimed is:

1. An infrared lens assembly operative in the near and far infrared wavebands, comprising:

a focusing component positioned along an optical axis to receive infrared radiation, the focusing component comprising at least one focusing lens formed from a material that has a minimal change in Abbe V-number between the far and near infrared wavebands;

a collecting component positioned along the optical axis in optical communication with the focusing component, the collecting component comprising at least one collecting lens formed from the material;

a diffracting component positioned along the optical axis in optical communication with the focusing and collecting components, the diffracting component comprising at least one diffractive surface to correct color aberrations associated with an infrared waveband; and the focusing and collecting components cooperating with the diffracting component to focus infrared radiation at an image plane of an infrared detector.

2. The infrared lens assembly of claim 1, the diffracting component further comprising a diffractive lens removably mounted in said lens assembly, the diffractive lens incorporating the diffractive surface.

3. The infrared lens assembly of claim 2, further comprising the diffractive lens formed from a polymer.

4. The infrared lens assembly of claim 2, further comprising the diffractive lens positioned along the optical axis between the focusing lens and the collecting lens.

5. The infrared lens assembly of claim 1, further comprising the diffractive surface formed on the focusing lens.

6. The infrared lens assembly of claim 1, the diffracting component further comprising:

the diffractive surface positioned along the optical axis proximate to the focusing lens;

a second diffracting surface to correct color aberrations associated with the infrared waveband; and the second diffractive surface positioned along the optical axis proximate to the collecting lens.

7. The infrared lens assembly of claim 6, the diffracting component further comprising:

a diffractive lens removably mounted in said lens assembly, the diffractive lens incorporating the diffractive surface; and a second diffractive lens removably mounted in said lens assembly, the second diffractive lens incorporating the second diffractive surface.

8. The infrared lens assembly of claim 1, the diffracting component further comprising:

a diffractive lens selectably mounted in said lens assembly, the diffractive lens incorporating the diffractive surface;

an alternate diffractive surface to correct color aberrations associated with a different infrared waveband; and an alternate diffractive lens selectably mounted in said lens assembly, the alternate diffractive lens incorporating the alternate diffractive surface.

9. The infrared lens assembly of claim 8, further comprising:

a filter wheel retaining the diffractive lens and the alternate diffractive lens; and the filter wheel operable to selectably position the diffractive lens and the alternate diffractive lens along the optical axis for optical communication with the focusing and collecting components.

10. The infrared lens assembly of claim 1, the focusing and collecting lenses further comprising aspheric surfaces.

11. The infrared lens assembly of claim 1, the material further comprising a delta V-number of less than 70.

12. The infrared lens assembly of claim 1, the material further comprising chalcogenide glass.

13. The infrared lens assembly of claim 1, the material further comprising TI 1173 glass.

14. The infrared lens assembly of claim 1, the focusing component further comprising:

an objective focusing lens; and a pair of zoom focusing lenses, the pair of zoom focusing lenses positioned between the objective focusing lens and the collecting component.

15. The infrared lens assembly of claim 1, the collecting component further comprising:

a first collecting lens positioned proximate to the image plane; and a second collecting lens positioned between the first collecting lens and the focusing component.

16. The infrared lens assembly of claim 1, further comprising:

the focusing component further comprising:

an objective focusing lens; and a pair of zoom focusing lenses, the pair of zoom focusing lenses positioned between the objective focusing lens and the collecting component;

the collecting component further comprising:

a first collecting lens positioned proximate to the image plane; and a second collecting lens positioned between the first collecting lens and the focusing component; and the diffracting component further comprising:

a diffractive lens removably mounted in said lens assembly, the diffractive lens incorporating the diffractive surface; and a second diffractive lens removably mounted in said lens assembly, the second diffractive lens incorporating the second diffractive surface.

17. The infrared lens assembly of claim 1, further comprising said infrared lens assembly being passively athermalized.

18. The infrared lens assembly of claim 1, further comprising a spacer mounting the collecting lens, the spacer operable to expand and contract with temperature changes in relation to a change of a refractive index of said infrared lens assembly.

19. An infrared imaging system operative in the near and far infrared wavebands, comprising:

an infrared detector operative in the near and far infrared wavebands, the infrared detector including an image plane positioned along an optical axis; and an infrared lens assembly operative in the near and far infrared wavebands, the infrared lens assembly in optical communication with the infrared detector and comprising:

a focusing component positioned along the optical axis to receive infrared radiation, the focusing component comprising at least one focusing lens formed from a material that has a minimal change in Abbe V-number between the far and near infrared wavebands;

a collecting component positioned along the optical axis in optical communication with the focusing component, the collecting component comprising at least one collecting lens formed from the material;

a diffracting component positioned along the optical axis in optical communication with the focusing and collecting components, the diffracting component comprising at least one diffractive surface to correct color aberrations associated with an infrared waveband; and the focusing and collecting components cooperating with the diffracting component to focus infrared radiation at the image plane of the infrared detector.

20. The infrared imaging system of claim 19, the diffracting component further comprising a diffractive lens removably mounted in said lens assembly, the diffractive lens incorporating the diffractive surface.

21. The infrared imaging system of claim 19, the diffracting component further comprising:

a diffractive lens selectably mounted in the lens assembly, the diffractive lens incorporating the diffractive surface;

an alternate diffractive surface to correct color aberrations associated with a different infrared waveband; and an alternate diffractive lens selectably mounted in the lens assembly, the alternate diffractive lens incorporating the alternate diffractive surface.

22. A method of focusing infrared radiation at an image plane of an infrared detector, comprising the steps of:

transmitting, at a focusing component positioned along an optical axis, infrared radiation via a material that has a minimal change in Abbe V-number between the far and near infrared wavebands;

transmitting, at a collecting component in optical communication with the focusing component, the infrared radiation via the material; and diffracting, at a diffracting component in optical communication with the focusing and collecting components, the infrared radiation to correct color aberrations.

23. An apparatus comprising an infrared lens system, said infrared lens system including:

a collecting and focusing section and a diffracting section which cooperate to focus infrared radiation at an image plane;

said collecting and focusing section including a plurality of lens elements which are located along an optical axis in optical communication with each other, and which are each made of a material having similar optical characteristics in each of first and second infrared wavebands that are respectively, a near infrared waveband and a far infrared waveband; and said diffracting section including a diffracting element having thereon a diffractive surface, wherein said diffractive element can be moved between operational and nonoperational locations in which said diffracting element is respectively located along and spaced from the optical axis, wherein when said diffracting element is in the operational location, said diffracting element is in optical communication with said lens elements, and said diffractive surface thereon corrects color aberrations in a selected one of the first and second wavebands.

24. An apparatus according to claim 23, wherein said diffracting element is a diffractive lens formed from a polymer.

25. An apparatus according to claim 23, wherein said diffracting section includes a further diffracting element having thereon a diffractive surface, and includes a member having each of said diffracting elements supported thereon, said member being movable so as to selectively position a one of said diffracting elements along the optical axis.

26. An apparatus according to claim 23, wherein said material from which said lens elements are made has a minimal change in Abbe number between the far and near infrared wave bands.

* * * * *